US009492057B2

(12) United States Patent
Dreossi et al.

(10) Patent No.: US 9,492,057 B2
(45) Date of Patent: Nov. 15, 2016

(54) DEVICE AND METHOD FOR A DISHWASHER

(75) Inventors: Giuseppe Dreossi, Stockholm (SE); Anders Haegermarck, Trangsund (SE); Bernd Krische, Saltsjo-Boo (SE); Petter Svanbom, Hagersten (SE)

(73) Assignee: Electrolux Home Products Corporation N.V., Brussels (BE)

( * ) Notice: Subject to any disclaimer, the term of this patent is extended or adjusted under 35 U.S.C. 154(b) by 905 days.

(21) Appl. No.: 13/699,236

(22) PCT Filed: May 13, 2011

(86) PCT No.: PCT/EP2011/057798

§ 371 (c)(1),
(2), (4) Date: Jan. 31, 2013

(87) PCT Pub. No.: WO2011/147700

PCT Pub. Date: Dec. 1, 2011

(65) Prior Publication Data

US 2013/0146091 A1 Jun. 13, 2013

(30) Foreign Application Priority Data

May 24, 2010 (EP) ..... 10005384

(51) Int. Cl.
*A47L 15/48* (2006.01)
*A47L 15/00* (2006.01)

(52) U.S. Cl.
CPC ..... *A47L 15/48* (2013.01); *A47L 15/481* (2013.01); *A47L 15/0042* (2013.01); *A47L 15/0052* (2013.01); *A47L 15/486* (2013.01); *A47L 2401/03* (2013.01); *A47L 2501/12* (2013.01)

(58) Field of Classification Search
None
See application file for complete search history.

(56) References Cited

U.S. PATENT DOCUMENTS 3,103,227 A 9/1963 Long
3,739,487 A 6/1973 Clark
(Continued)

FOREIGN PATENT DOCUMENTS

CN 200960107 Y 10/2007
CN 200987659 Y 12/2007
(Continued)

OTHER PUBLICATIONS

Written Opinion from International Application No. PCT/EP2011/057798, dated Jun. 21, 2011.
Extended European Search Report from European Application No. 10005384.2, dated Dec. 6, 2010.
Office Action from Chinese Patent Application No. 201180025319.4, dated Jul. 1, 2014.
European Search Report for Application No. EP 10 00 5383 dated Oct. 19, 2010.
(Continued)

*Primary Examiner* — Michael Kornakov
*Assistant Examiner* — Ryan Coleman
(74) *Attorney, Agent, or Firm* — Alston & Bird LLP

(57) ABSTRACT

A device (5), arranged for fluid communication with a washing chamber (2) of a dishwasher (1), the device further being arranged to allow a passage of air (9) between the washing chamber and the device, the device comprising a drying material (10) arranged in a bed (11), the drying material being able to withdraw moisture from the air passing through the bed during a withdrawal step, and release moisture to the air during a regeneration step, a heating element (13) arranged in the bed arranged to heat the drying material during the regeneration step such that moisture is released from the drying material, and a fan (14), arranged to circulate the air between the device and the washing chamber such that the air flow rate during the withdrawal step is higher than the air flow rate during the regeneration step by altering the fan speed.

15 Claims, 3 Drawing Sheets

(56) References Cited

U.S. PATENT DOCUMENTS

| | | | | |
|---|---|---|---|---|
| 3,821,961 | A * | 7/1974 | Schimke | 134/182 |
| 5,555,640 | A | 9/1996 | Ou | |
| 8,734,592 | B2 | 5/2014 | Jerg et al. | |
| 8,858,727 | B2 | 10/2014 | Jerg et al. | |
| 8,869,424 | B2 | 10/2014 | Hermann et al. | |
| 2001/0042557 | A1 | 11/2001 | Moh | |
| 2003/0221709 | A1 | 12/2003 | Jung et al. | |
| 2004/0045187 | A1* | 3/2004 | Curry | D06F 58/263 34/595 |
| 2005/0150528 | A1 | 7/2005 | Kim | |
| 2006/0278257 | A1 | 12/2006 | Jerg et al. | |
| 2007/0295360 | A1 | 12/2007 | Jerg et al. | |
| 2007/0295373 | A1 | 12/2007 | Jerg et al. | |
| 2008/0006308 | A1 | 1/2008 | Classen et al. | |
| 2008/0011329 | A1 | 1/2008 | Classen et al. | |
| 2008/0083433 | A1 | 4/2008 | Jerg et al. | |
| 2008/0127997 | A1 | 6/2008 | Jerg et al. | |
| 2008/0283099 | A1 | 11/2008 | Peukert et al. | |
| 2010/0024982 | A1* | 2/2010 | Wallace et al. | 156/345.27 |
| 2011/0048464 | A1 | 3/2011 | Rieger et al. | |
| 2011/0139196 | A1 | 6/2011 | Bartos et al. | |
| 2011/0146718 | A1 | 6/2011 | Heidel et al. | |
| 2011/0186094 | A1 | 8/2011 | Hong | |
| 2013/0125411 | A1 | 5/2013 | Dreossi et al. | |
| 2014/0007767 | A1 | 1/2014 | Grunewald | |
| 2014/0060597 | A1 | 3/2014 | Welch | |

FOREIGN PATENT DOCUMENTS

| | | | |
|---|---|---|---|
| DE | 37 41 652 | A1 | 6/1989 |
| DE | 103 53 774 | A1 | 2/2005 |
| DE | 60 2005 004740 | T2 | 2/2009 |
| EP | 1 674 030 | A1 | 6/2006 |
| EP | 2 353 487 | A2 | 8/2011 |
| EP | 2 389 854 | A1 | 11/2011 |
| JP | S61 162985 | A | 7/1986 |
| WO | WO-2006/029953 | A1 | 3/2006 |
| WO | WO-2007/043863 | A1 | 4/2007 |
| WO | WO 2011/147700 | A1 | 12/2011 |

OTHER PUBLICATIONS

Office Action for European Application No. 11 718 743.5 dated Aug. 18, 2014.

International Search Report for Application No. PCT/EP2011/057533 dated Nov. 8, 2011.

Written Opinion for International Application No. PCT/EP2011/057533 dated Nov. 8, 2011.

Office Action for U.S. Appl. No. 13/699,228 dated Nov. 6, 2014.

International Search Report for Application No. PCT/EP2011/057798 dated Jun. 21, 2011.

* cited by examiner

DEVICE AND METHOD FOR A DISHWASHER

CROSS REFERENCE TO RELATED APPLICATIONS

This application is a national stage application filed under 35 U.S.C. 371 of International Application No. PCT/EP2011/057798, filed May 13, 2011, which claims priority from European Patent Application No. 10005384.2, filed May 24, 2010, each of which is incorporated by reference herein in its entirety.

FIELD OF THE INVENTION

The present invention relates to a device and a method for the processing of air in a dishwasher.

BACKGROUND OF THE INVENTION

The operation of a conventional dishwasher generally comprises a washing program of processes performed sequentially, such as e.g. a "pre-wash" step followed by a "clean" wash step, an "intermediate" wash step, and a "clear" wash step, or the like.

Occasionally, the washing program further comprises a "drying" step, wherein goods positioned in the washing container of the dish washer such as e.g. cutlery, glasses, plates, and/or pottery are dried from adhering water. Analogously, a "humidifying" step may be comprised in the program for applying humid air on the goods positioned in the washing container.

In the prior art, dishwashing machines and processes are shown with the aim to improve the operation of the washing cycle. More specifically for this application, there are prior art documents which propose techniques for the step of drying and the step of humidifying in a dishwashing machine.

In patent document US2007/0295373, a dishwashing machine is disclosed comprising a washing container, a heating device and a sorption drying device. The sorption drying device in the disclosure comprises a reversibly dehydratable material that acts as an adsorbent of moisture from air during the passage of air through the sorption drying device. Thus, air that passes through the sorption drying device may be dried by the dehydratable material, such that washed crockery, comprised in the washing machine, may be dried.

For generating an air flow when the sorption drying device is in use, a fan is provided. Furthermore, a heating device is arranged in the region of the vicinity of the air inlet of the sorption column, such that the air which is to pass the dehydratable material is heated at the input of the sorption column.

However, there are problems related to this invention. The dishwashing machine as disclosed, and consequently, the operation of the dishwashing machine, have deficiencies as the machine is not optimized regarding the energy efficiency.

SUMMARY OF THE INVENTION

It is an object of the present invention to improve on the concept of energy efficiency and to provide a device that improves the energy efficiency of a dish washer.

This and other objects are achieved by providing a device having the features defined in the independent claim. Preferred embodiments are defined in the dependent claims.

According to the present invention, there is provided a device, arranged for fluid communication with a washing chamber of a dish washer, the device further being arranged to allow a passage of air between the washing chamber and the device, the device comprising a drying material arranged in a bed, the bed being arranged for a passage of air through the bed, the drying material being able to withdraw moisture from the air passing through the bed during a withdrawal step when the device is in use, and release moisture to the air during a regeneration step when the device is in use, a heating element arranged in the bed, the heating element being arranged to heat the drying material during the regeneration step when the device is in use such that moisture is released from the drying material, and a fan, arranged to circulate the air between the device and the washing chamber such that the mean air flow rate through the bed during the withdrawal step is higher than the mean air flow rate through the bed during the regeneration step by altering the fan speed.

Thus, the device of the present invention is based on the idea of providing a device which provides an improved withdrawal and regeneration of moisture from air for the processing of air in a dish washer. The fan, comprised in the device, is operated at a mean speed during the withdrawal step which is different to the mean speed during the regeneration step, thereby further optimizing the operation of the device when in use. Thus, the present invention yields a more efficient and energy-saving device compared with arrangements in the prior art, as the fan speed is altered such that the mean speed of the fan is lower during the regeneration step than during the withdrawal step.

The device of the present invention is arranged for fluid communication with a washing chamber of a dish washer. By the term "fluid communication", it is here meant that a fluid such as e.g. air with varying amounts of moisture may pass between the device and the washing chamber, and vice versa, of the dish washer, i.e. that the device allows a passage of air between the device and the washing chamber, as well as between the washing chamber and the device.

Furthermore, the device comprises a drying material. This material may be any kind of material that can take up moisture, i.e. water, from air and then be regenerated by releasing the moisture back to air, depending on the conditions such as material temperature, moisture saturation of the air and/or of the material, to which the material is subjected. In other words, the material may be a dehydratable material, wherein the uptake and release of moisture is reversible, such that the material may act as an absorber and a desorber of moisture.

The drying material as such may be realized in the device in any shape, still being able to withdraw moisture and to regenerate moisture. As examples, the material may be provided as chunks, pellets, flakes, powder or as a monolithic block.

Furthermore, the drying material is arranged in a bed which is arranged for a passage of air through the bed. Thus, the bed and the drying material arranged therein is air-permeable, such that air may pass through the bed.

The drying material may have the advantageous property of a high surface-area-to-weight ratio, i.e. that the structure of the drying material is such that the material provides a big contact area for the uptake of water.

The drying material is able to withdraw moisture from the air passing through the bed during a withdrawal step when the device is in use. In this withdrawal step, air from the washing chamber of the dish washer flows through the device, wherein the air from the washing chamber may be very humid. The moisture comprised in the air passing through the device may at least partially be withdrawn or bound by the drying material, such that the "drying" of the air thereby facilitates the drying of the goods comprised in the washing chamber. Hence, by the word "withdraw", it is here meant that the drying material may adsorb, absorb, or otherwise bind or hold the moisture (i.e. water) in the air passing through the bed. As a result, the air within the washing chamber becomes dryer when the air that has passed through the bed is reintroduced into the chamber.

Thus, the humidity of the air before passing the drying material is higher than the humidity of the air after passing the drying material, in the withdrawal step. Hence, in the withdrawal step, the drying material acts as a "dryer" of the air, and may bind some of the moisture of the passing air.

Furthermore, the air passing the drying material during the withdrawal step is heated by the heat of adsorption. In other words, the humid air, before passing the drying material, has a lower temperature than the temperature of the dryer air after passing the drying material. This increase of temperature is advantageous as additional heating of the air that is to enter into the washing chamber may possibly not be necessary. Furthermore, the heated air may more easily take up moisture from the goods before reentering into the device.

Analogously, the drying material is able to release moisture to the air during a regeneration step, when the device is in use. Contrary to the withdrawal step, air from the washing chamber of the dish washer, before applying the regeneration step, may be relatively dry. Thus, the drying material may be at least partially regenerated by releasing the moisture (i.e. water), which is associated with the drying material, to the air. In other words, the drying material may release the moisture to the air, such that the air in the washing chamber becomes more humid.

In the regeneration step, the drying material is able to release moisture to the air during operation of the fan. In this case, the drying material is able to release moisture to the air passing through the bed. Also, the drying material is able to release moisture to the air when the fan is not operated, i.e. when no air passes through the bed.

In the regeneration step, and during operation of the fan, the humidity of the air after passing the drying material is higher than the humidity of the air before passing the drying material. Thus, the drying material may release the moisture or water which is bound in the material, to the passing air.

To reduce the humidity uptake during a washing or a rinsing phase of the dish washer, back valves may be implemented. By this, moisture is prevented from reversing into the "wrong" direction during regeneration. Furthermore, a water trap may be implemented in the device in order to condense excessive moisture from passing air.

A heating element is arranged in the bed, wherein the heating element is arranged to heat the drying material during the regeneration step when the device is in use such that moisture is released from the drying material.

The term "heating element" may be construed as any heat-producing unit, cell, radiator, or the like, known to the man skilled in the art. As a further example, a thin-film heater could be a possible heating element.

The heating element, being arranged in the bed, may be in direct, thermal contact with the drying material. In other words, the heating element may be embedded in the material bed such that the heating may provide a direct, uniform heating of the drying material. This is advantageous regarding the energy consumption of the device, as the transmission of heat between the heating element and the drying material hereby is provided efficiently. Thus, the arrangement yields an improved heating such that any heat losses between the heating element and the drying material is minimized.

When the device is in use, the heating element is arranged to heat the drying material during the regeneration step to a sufficiently high temperature such that the material may be regenerated. During the regeneration step, the moisture is released from the drying material, such that the humidified air is passed from the device to the washing chamber of the dish washer. Thus, the hot, humid air enters the washing chamber and thereby heats up and moistens goods comprised therein such as e.g. glasses, cutlery, plates, and/or cups. This is advantageous, as the hot, humid air may e.g. loosen ingrained food, grime or stains on the goods.

Furthermore, the increase in temperature of the air by means of the heating element is further advantageous considering that any further heating of the air before entering the washing chamber may be dispensed with.

The device further comprises a fan which is arranged to circulate the air between the device and the washing chamber, i.e. that air may be circulated from the washing chamber, to the device, back to the washing chamber, and so on.

In the withdrawal step, the fan circulates the air such that the goods comprised in the washing chamber may dry. In other words, in the cycle generated by the fan, the drying material decreases the amount of humidity in the washing chamber.

Analogously, in the regeneration step, the fan may circulate the air such that the goods comprised in the washing are heated and humidified by the hot, humid air from the drying material, i.e. in the cycle generated by the fan, the drying material increases the amount of humidity in the washing chamber.

By the word "fan" it is in this context meant e.g. a propeller, a turbine, or pumping device, such that an air flow is generated when the device is in use.

The positioning of the fan in the device may for example be directly upstream of the bed. As an example, the fan may be provided in the vicinity of the bed, through which bed air is blown when the device is in use. Alternatively, the fan may be so closely provided to the bed such that the bed and the fan may be provided as a compact unit, to save space in the dish washer. However, any other positioning of the fan in the device is feasible, wherein the fan still provides a flow of air.

When the device is in use, the mean air flow rate through the bed during the withdrawal step is higher than the mean air flow rate during the regeneration step, wherein the term "air flow rate" should here be construed as the amount of air circulated by the fan as a function of time. The mean air flow rate during the withdrawal step is made higher than the mean air flow rate during the regeneration step by altering the fan speed and/or operating the fan intermittently.

Thus, during the withdrawal step, wherein the goods comprised in the washing chamber are to be dried, the fan speed is set such that the air passes the device at a certain flow rate. Hence, the time of the cycle for the air passage from the washing chamber of the dish washer, to the device, and back to the dish washer, is a function of the flow rate of the withdrawal step.

Analogously, before or during the regeneration step, wherein moisture is released from the drying material such that humid air is passed to the goods comprised in the washing chamber, the fan speed is altered. More precisely, the fan speed is set such that the air passes the device at a mean flow rate which is lower than the mean air flow rate of the withdrawal step.

During the regeneration step, the fan speed may be such that the flow rate is not zero, i.e. that an air flow is generated and that moisture is released from the drying material to the passing air. Alternatively, the fan speed may be such that the flow rate is zero during the regeneration step. However, the drying material may still regenerate such that moisture is released from the drying material to the air.

By altering the fan speed or operating the fan intermittently, the mean amount of air flow of the regeneration step is smaller than the mean amount of air flow of the withdrawal step.

The arrangement of altering the fan speed for the two different steps of withdrawal and regeneration is advantageous regarding several aspects. By the arrangement of the present invention, the mean air flow rate of the regeneration step may be lower compared to the air flow rate of the withdrawal step. The lower air flow rate of the regeneration step, which is an effect of a lower mean fan speed, provides a more energy-saving mode of the device when it is in use compared to a higher air flow rate.

The device and method of the present invention contributes to a decrease of energy use. This is beneficial not only for environmental aspects, but also for the economics regarding the operation of the dish washer.

Furthermore, as a rotating operation, such as a rotation of a fan, often is directly related to noise, the lower fan speed of the regeneration step may give a more quiet operation of the device, i.e. a noise reduction when the dish washer is in use. This is highly advantageous as dish washers often are present in kitchens, in which people often spend much time for e.g. preparing meals and eating. Thus, a more silent dish washer contributes to a more pleasant and agreeable kitchen environment.

According to an embodiment of the present invention, the fan is arranged for a speed during the withdrawal step, which speed is substantially constant. Thus, when the device is in use, the fan speed is substantially constant during the withdrawal step such that air passing the drying material comprised in the bed may be passed in a substantially constant air flow. As the fan speed is substantially constant, noise disturbances related to varying fan speeds may be circumvented.

According to an embodiment of the present invention, the fan is arranged for a speed during the regeneration step, which speed is substantially constant. Thus, when the device is in use, the fan speed is substantially constant during the regeneration step such that air passing from the drying material comprised in the bed to the washing chamber may be passed in a substantially constant air flow.

In this embodiment, the fan is arranged for a speed during the withdrawal step and a speed during the regeneration step. However, the mean speed of the fan in the regeneration step is arranged to be lower than the mean speed of the fan in the withdrawal step. Thus, by an altering of the fan speed from the constant fan speed of the withdrawal step to the constant fan speed of the regeneration step, the mean fan speed is decreased.

An embodiment of a substantially constant speed of the fan during the regeneration step may avoid noise disturbances in relation to varying fan speeds. Furthermore, as the magnitude of a rotating operation, such as the rotation of a fan, often is directly related to noise, the lower fan speed of the regeneration step yields a more quiet operation of the device, i.e. a noise reduction when the dish washer is in use.

According to an embodiment of the present invention, the fan is arranged for a speed during the regeneration step, which speed is substantially periodical. By the term "periodical" it is here meant that the fan is arranged for a speed having a magnitude which is cyclic. As an example, the fan may be arranged for a speed such that the fan is switched between an "on" and an "off" mode, i.e. that the fan is turned on for a certain time period, then switched off for a certain time period, then turned back on, etc. This means that the operation of the fan is not continuous in the present embodiment.

The substantially periodical operation of the fan speed may be interpreted as "puffs", i.e. air blown at short periods from the fan, such that the air flow during the regeneration step is driven by a cyclic operation of the fan with short time periods when the fan is on and long time periods when the fan is off.

As another example, the fan may be arranged for a speed which is sinusoidal, "saw-tooth-shaped", or the like, such that the fan speed over time is cyclic and repetitive, but that the fan speed is gradually increased from a minimum speed to a maximum speed, and vice versa. Alternatively, any other function for the fan speed over time is feasible, wherein the mean air flow rate during the regeneration step is lower than the mean air flow rate during the withdrawal step.

An advantage with an embodiment wherein the fan is arranged for a substantially periodical speed during the regeneration step is that the periodical operation of the fan is energy saving, as the time of the fan at operation is decreased compared to a regular operation of the fan. As an example, the fan may be arranged for a speed during the regeneration step, wherein the maximum speed has approximately the same speed as the constant speed of the fan during the withdrawal step. Analogously, the fan may be arranged for a speed during the regeneration step, wherein the minimum speed is lower than the constant speed of the fan during the withdrawal step.

A further advantage with the periodical operation of the fan is that any noise related to the operation of the fan may be reduced in connection with operation intermissions, i.e. when the fan is switched off.

As an example, operations of air cycles imply that e.g. fans during steps of drying goods comprised in dish washers in the prior art may be e.g. 25 minutes long, or possibly, as long as 1 hour, wherein the fan is operated at a constant speed. In an embodiment of the present invention, however, the fan may operate at an aggregate time of as low as e.g. 3 minutes during the total time of the regeneration step, wherein during the remaining time of the regeneration step, the fan is switched off. This comparison further emphasizes the advantages of the present invention which relates to a more efficient regeneration step of the device in the dish washer, leading to e.g. a more environmental friendly, noise reduced, and more economical operation of the dish washer comprising the device.

According to an embodiment of the present invention, the heating element is an electrical heating resistor in the form of a wire, a coil, a loop or a sheet. This embodiment is advantageous regarding several aspects. The heating element, arranged in the bed, may in the form of a wire, a coil or a loop be provided in a close vicinity, immediately adjacent, or directly in contact with the drying material that is to be heated during the regeneration step. In other words, the form of the heating element may to a higher extent integrate with the drying material, compared to a more bulky realization of a heating element. The wire, coil or loop of the heating element may increase the efficiency of the heating of the drying material and mitigates heat loss effects.

Furthermore, the examples presented for the heating element may be provided throughout the bed comprising the drying material, e.g. a wire may be distributed within the bed such that a more uniform heating of the drying material is achieved. Moreover, the examples of the embodiment, such as a wire, a coil, or a loop, yield a more permeable bed for the air to pass through when the device is in use, compared to a more bulky heating element, blocking the flow of air. Thus, the present embodiment results in an even more efficient operation of the device.

Furthermore, a plurality of heating elements comprised in the device may be feasible to yield a more desirable heating. As an example, the heating element may comprise several element of a kind, e.g. several wires, coils, loops, sheets, or the like. Alternatively, any combination of heating elements may be feasible, e.g. one or more wires, coils, loops, and/or sheets.

According to an embodiment of the present invention, the drying material comprises activated alumina. The activated alumina has a very high surface-area-to-weight ratio which makes it very suitable for the withdrawal of moisture. The air moisture sticks to the alumina itself in between tiny passages in the material, as air passes through. The moisture becomes trapped so that the air is dried out as it passes through the bed in the withdrawal step. This process is reversible, and in the regeneration step, the alumina is heated such that the moisture stored is released.

By "activated alumina", it is here meant $Al_2O_3$. However, any similar compound with similar properties of those described above for the activated alumina, could also be a feasible embodiment of a drying material. As an example, zeolite and/or silica may be used.

An advantage of the use of activated alumina is that the material may withdraw moisture and regenerate at a much lower temperature than other drying materials used in the prior art. As an example, the activated alumina in the regeneration step may be heated to a lower temperature, compared to the use of e.g. zeolite. Moreover it tolerates contact with liquid water better than other alternatives. Furthermore, as the material cost of activated alumina is less than that of zeolite, the activated alumina of the present invention does not only contribute to an easier and faster heating of the drying material, but also cheaper.

Furthermore, by the use of activated alumina as a drying material, the regeneration step may be performed quicker as the regeneration temperature is reached faster.

According to an embodiment of the present invention, the drying material is arranged to be heated by the heating element in the regeneration step to a temperature of 100-250° C., such as 130-200° C., such as 150-180° C. Thus, the activated alumina may be heated by the heating element to 130-200° C., such as 150-180° C. for regeneration when the device is in use.

As a comparing example, the use of zeolite as a drying material may require a heating of the material to approximately 250° C. for a release of moisture from the material. Thus, by the embodiment of the present invention, the example further emphasizes the advantages of the use of activated alumina compared to e.g. zeolite regarding factors such as cost and efficiency.

Another advantage of the activated alumina is that the temperature increase of the passing air during withdrawal becomes lower with this material compared with e.g. zeolite. In other words, during the withdrawal step, when moisture is to be withdrawn from the air passing through the bed, the reaction wherein the moisture condensates is less exothermic compared with zeolite. Thus, the temperature of the passing air after the withdrawal step using activated alumina is lower than the temperature of the passing air if zeolite is used. As high-temperature air passing into the washing chamber may deform and/or melt components such as plastic devices or the like, arranged in the washing chamber, the use of activated alumina may be preferred.

The heat which is generated by the exothermic reaction at the withdrawal step may be used to e.g. heat water for a later stage in the dish cycle.

Another advantage of using activated alumina is that the material is not sensitive to water, i.e. that water is not detrimental to the activated alumina. Therefore, at the regeneration step, it is not necessary to have an uninterrupted passage of air through the bed which transports the moisture from the drying material.

According to an embodiment of the present invention, the device further comprises a container at least partly enclosing the bed, the container being arranged for a passage of air through the container. The container holds the bed comprising the drying material and it may be formed such that the bed is protected from damage and/or wear. Furthermore, the container may keep the bed compact and shield the bed from e.g. the fan such that pieces or dust from the drying material do not enter into the fan.

As the container is arranged for a passage of air through the container, the portion of the container facing the incoming air which is to pass through the bed, and the portion of the container through which the air leaves the container may consist of an easily permeable material or structure such as e.g. a net, a mesh or a grid of wire.

According to an embodiment of the present invention, the container comprises a heat resistant insulating material such as a mineral material, e.g. Mica or alumina. Alternatively, the heat resistant insulating material may be a high temperature polymer, e.g. polyimide.

The heat resistant insulating material may further be electrically insulating, which provides several advantages. As an example, the heating of the bed may be performed more efficiently, as the electrical insulation of the container enables more direct heating options within the bed.

Furthermore, the heat resistant insulating material provides a container which, when the device is in use, does not become as hot as a container of a heat-conducting material such as e.g. metal. Thus, the container comprising the heat resistant insulating material forms a container that allows high temperatures within the container.

Furthermore, the heat resistant insulating material is heat resistant such that the material may withstand high temperatures without melting, or deforming. Examples of materials may be ceramics, glass, high temperature polymers or natural minerals that can be shaped into desirable forms.

According to an embodiment of the present invention, the mineral is a Mica mineral. By "Mica", it is here meant a compound which may be of the kind $(K, Na, Ca)_2(Al, Mg, Fe)_{4-6}(Si, Al)_8O_{20}(OH, F)_4$.

Mica is a desirable mineral for a container as comprised in this invention. As an example, the Mica mineral may be split into very thin slices while retaining thermal resistance, and further, it may be formed into sheets that are easily cut still having sufficient mechanical strength and good electrical insulation properties. Thus, the container comprising the Mica mineral may be thin, i.e. the walls of the container may be thin. This decreases the size of the container, and furthermore, the size of the device such that the dish washer may be made smaller, or analogously, that more space is available for the dish to be washed.

Furthermore, the Mica mineral has extremely low thermal conductivity, which makes the material especially suitable for the high-temperature conditions within the container during operation, as the material mitigates the conduction of heat to the exterior.

Furthermore, the Mica mineral is refractory enough to withstand temperatures as high as 1200° C. Thus, the resistance to heat of the Mica mineral is highly advantageous for the application in dish washers, or the like, wherein the high temperatures may be detrimental for other material used.

Furthermore, the Mica mineral is inexpensive, which further emphasizes the suitability of the mineral for the purpose of the invention.

A further advantage of the use of the Mica mineral is its low thermal expansion. Thus, in the high-temperature environment that may arise in the dishwasher during operation, a container comprising a Mica mineral may to a higher extent conserve its shape compared with, for example, any metallic-based container, having a higher thermal expansion. This may have the further advantage if the container in its turn is enclosed by e.g. a housing. As an example of this, it is suitable that the container and the housing may have approximately the same low thermal expansion. By this, any air gap between the container and the housing may be conserved even when the items are subjected to high temperatures during operation of the dish washer, such that the insulating properties of the device are maintained.

In the case of a container shaped as a parallelepiped, the two sides of the container being perpendicular to the air flow, when the device is in use, may comprise e.g. a net of metal wire, whereas the four sides of the container being parallel to the air flow may comprise a Mica mineral.

According to an embodiment of the present invention, the device further comprises a housing at least partly enclosing the container, wherein the housing comprises an inlet and an outlet arranged for passage of air through the housing. In other words, the device comprises a container at least partly enclosing the bed, which container in its turn is at least partly enclosed by a housing. Furthermore, the housing comprises an air inlet and an air outlet, such that when the device is in use, air may pass through the interior of the housing.

By this embodiment, there is provided a "double wall" structure for the bed which is advantageous regarding properties such as heat insulation and protection. Furthermore, the housing is constructed such that air may pass through the inlet of the housing, pass through the container wherein the bed with the drying material is comprised, and thereafter pass through the outlet of the housing.

According to an embodiment of the present invention, the housing comprises an insulating material such as a plastic. The insulating material of the housing further improves the heat insulation of the device, such that the heating of the bed may be operated more efficiently. Furthermore, the insulating material may provide electrical insulation for the housing.

Furthermore, the housing provides a heat insulation vis-à-vis the exterior, such that an exterior heating is avoided or reduced. By this, it is meant that dissipative transfer of heat from the heating element during the regeneration step to e.g. the portion of the dish washer where the device is located, is mitigated. As an example, the heat insulating material of the container may avoid that a portion of the dish washer, facing a user or facing kitchen equipment and/or furniture provided adjacent the dish washer, gets hot. The embodiment provides an improvement of the container in this aspect compared to e.g. metal covers, wherein the heat-conductive metal may transfer heat to its surroundings which may be energy inefficient, and possibly, hazardous.

The heat insulating material may comprise a plastic. The term "plastic" should here be construed in the broader range of the term than normally used, i.e. that the material is a synthetic or semi-synthetic material which has high insulating properties, which tolerates heat and which is easy to shape for industrial applications. Thus, any kind of plastic, or plastic-like material, such as e.g. polyamide, polypropylene, polystyrene, polyvinyl chloride, or polyethylene may be feasible materials for the housing.

A further advantage with the use of plastic for the housing is that the material gives higher freedom of design and integration of other structural parts compared to e.g. metal.

According to an embodiment of the present invention, a space is defined by means of spacers between the container and the housing, such that a portion of the air passing through the housing passes between the container and the housing, without passing through the bed, when the device is in use. By this, it is meant that the housing encloses the container in such a way that a space is provided between the container and the housing, wherein e.g. spacers are provided to maintain the space. As an example, both the container and the housing may have similar shapes, but wherein the size of the housing is slightly bigger than the container, such that a space is formed between the housing and the container.

Furthermore, the housing and the container may be formed in such a way that the space is arranged as a passage for air, when the device is in use. As an example, a small portion of the air, which air is circulated by means of the fan, may pass in the space around the container, whereas a major portion of the air may pass through the container for passing the drying material in the withdrawal step or regeneration step, when the device is in use. This means that the air may be divided when entering the housing, and merged when exiting the housing, such that there are two portions of air passing through the housing, i.e. one small portion of air passing around the container, and a major portion of air passing through the container and the bed. Alternatively, the passing of the air in this embodiment may be seen as a small "leakage" of air around the container, instead of through the container.

An advantage with the present embodiment is that the passage of air around the container may cool the housing. As an example, the temperature of the air passing through the container and through the bed during the regeneration step, when the bed is heated, may be approximately 170° C. However, the air passing the housing which does not pass through the container and the heating element of the bed is consequently not heated to this temperature. By this, this portion of the air may pass the space between the container and the housing, creating an air gap, thereby cooling the housing.

Furthermore, the passage of air when the device is in use may work as a heat insulator for the housing such that the heat transfer from the container is further mitigated. By this, the temperature of the housing may be kept under 100° C., thereby avoiding damage to the housing as a result of excessive heat.

As an example of the construction of the device, the container may be shaped as a parallelepiped and the housing as a somewhat bigger parallelepiped, such that the container is enclosed in the housing. The space between the container and the housing, through which space air may pass, may be 1-2 mm wide.

According to the present invention, there is provided a method of processing air in a dish washer, the dish washer comprising a washing chamber and a device, the device comprising a drying material arranged in a bed, a heating element arranged in the bed and a fan, the method comprising circulating the air between the washing chamber and the device such that at least part of the air passes through the bed allowing the air to contact the drying material of said bed, withdrawing moisture from the air passing through the bed by means of the drying material, the air passing through the bed at a first mean flow rate, regenerating the drying material by heating the bed by means of the heating element and releasing at least part of the moisture to the air at a second mean flow rate, and altering the fan speed such that the first mean flow rate is higher than the second mean flow rate.

The discussion above relating to the device is in applicable parts also relevant to the method. Reference is made to that discussion.

BRIEF DESCRIPTION OF THE DRAWINGS

These and other aspects of the present invention will now be described in more detail, with reference to the appended drawings, wherein.

DETAILED DESCRIPTION

In the following description, the present invention is described with reference to a device arranged for fluid communication with a washing chamber of a dish washer.

Figure 1:
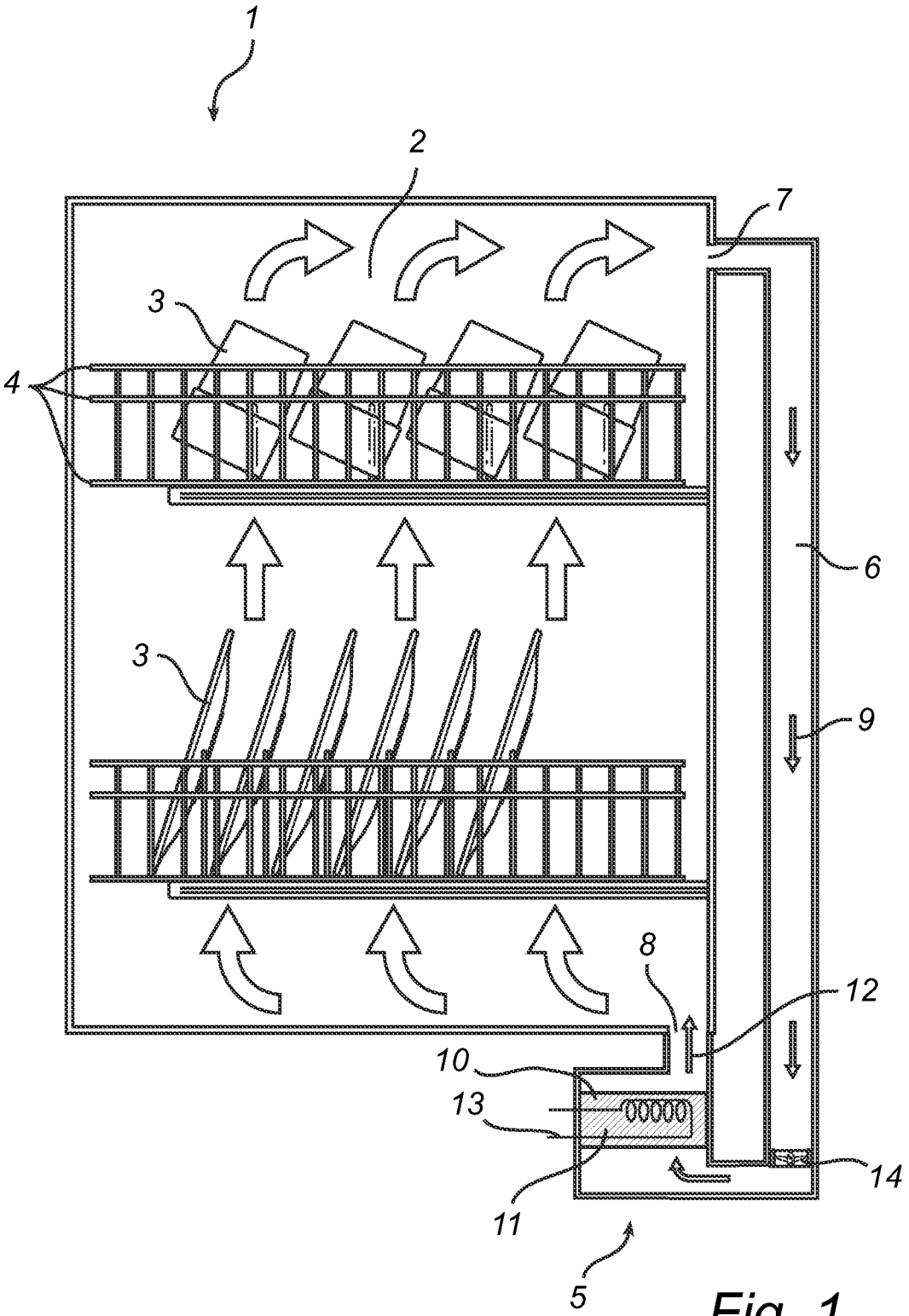
FIG. 1 is a schematic cross-sectional view of a dish washer comprising a device according to an embodiment of the present invention.

In FIG. 1, a schematic cross-sectional view of a dishwasher 1 is shown, wherein the dishwasher 1 comprises a washing chamber 2. Goods 3 that are to be washed such as e.g. glasses, cutlery, plates, and/or cups may be provided in dish trays 4 within the washing chamber 2.

Adjacent the washing chamber 2 is provided a device 5, wherein the device 5 is in fluid communication with the washing chamber 2. The device 5 comprises a duct 6 which is elongated and provided vertically in a close vicinity to the washing chamber 2. The duct 6 elongates from the top of the washing chamber 2, wherein an inlet 7 of the duct 6 is provided, to the bottom of the washing chamber 2. At the bottom of the duct 6, an outlet 8 of the duct 6 is provided into the washing chamber 2. Thus, the duct 6 of the device 5 is arranged for allowing a passage of air 9 between the washing chamber 2 and the device 5.

As shown in FIG. 1, the washing chamber 2 and the device 5 provides a circulation of air from the washing chamber 2, into the duct 6 of the device 5, back to the washing chamber 2, and so on, when the device 5 is in use.

In the vicinity of the outlet 8 of the duct 6, there is provided a drying material 10 within the duct 6. The drying material 10 may be in the form of e.g. chunks, pellets, flakes, or powder, or in the form of a monolithic block. The drying material 10 is arranged in a bed 11, wherein the bed 11 is arranged in the duct 6 for a passage of air 9 through the bed 11 and contacting the drying material 10. Thus, the bed 11 and the drying material 10 are permeable such that the air 9 may pass through the bed 11 comprising the drying material 10.

The drying material 10 arranged in the bed 11 may withdraw moisture from the air 9 passing through the bed 11 during a withdrawal step when the device 5 is in use. Thus, the drying material 10 may "dry" the air 9 passing through the duct 6 to the washing chamber 2 such that the air 12, after passing the drying material 10, may be relatively dry.

The air 9 from the washing chamber 2 of the dishwasher 1 which flows through the drying material 10 may be very humid. The moisture comprised in the air 9 passing through the drying material 10 may at least partly be withdrawn by the drying material 10, i.e. the drying material 10 may at least partly adsorb, absorb, bind or hold the moisture (i.e. water) in the air 9 passing through the bed 11. Thus, the air 12, i.e. the air 9 after passing the drying material 10, is dried during the withdrawal step.

At the withdrawal step, the air 12 is heated by the heat of condensation. Thus, the air 12 which reenters the washing chamber 2 has a higher temperature than the air 9 coming into the bed 11. The heated air 12 may take up moisture from the goods 3 before reentering into the device 5.

Analogously, the drying material 10 arranged in the bed 11 may release moisture to the air 12 during a regeneration step when the device 5 is in use. Thus, the drying material 10 may regenerate such that the moisture (i.e. water), which is held in the drying material 10, may be released to the air 12.

A heating element 13 is arranged in the bed 11, wherein the heating element 13 is arranged to heat the drying material 10 during the regeneration step when the device 5 is in use. By this, moisture may be released from the drying material 10.

The heating element 13, depicted in FIG. 1 as a coil, is provided within the bed 11 to generate a uniform heating of the drying material 10 during the regeneration step. Thus, the heat from the heating element 11 increases the temperature of the drying material 10 to a relatively high temperature. By this, the drying material 10 may release moisture previously withdrawn from the air 9 by the drying material 10.

A fan 14 is provided at the bottom of the duct 6, in the vicinity of the bed 11, wherein the fan 14 is arranged to circulate the air 9 between the device 5 and the washing chamber 2. Thus, the fan 14 circulates the air 9 of the duct 6, through the bed 11 comprising the drying material 10, into the washing chamber 2, back to the duct 6, and so on.

In the regeneration step and during operation of the fan 14, the drying material 10 may release the moisture to the air 9 passing through the bed 11. Thus, the air 12, i.e. the air 9 after passing the drying material 10, is humidified during the regeneration step.

In FIG. 2, the fan speed, in arbitrary units, is shown as a function of time, in arbitrary units, according to embodiments of the present invention.

Figure 2A:
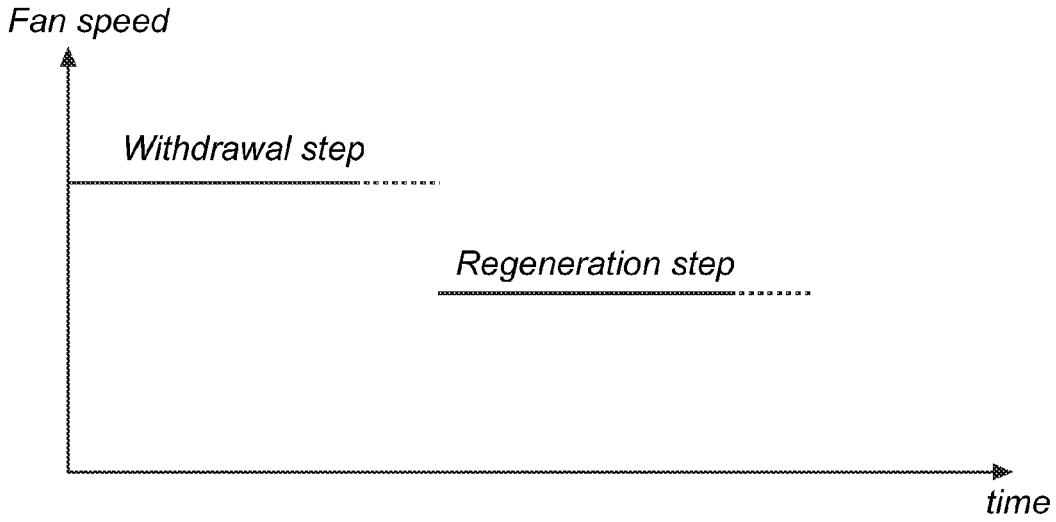
FIGS. 2*a*-2*c* are schematic diagrams illustrating the fan speed as a function of time according to embodiments of the present invention.

FIG. 2*a* shows an embodiment wherein the air flow rate through the bed 11 during the withdrawal step is constant and higher than the constant air flow rate during the regeneration step, by altering the fan speed. Thus, during the withdrawal step, the mean fan speed is higher than the mean fan speed during the regeneration step.

Figure 2B:
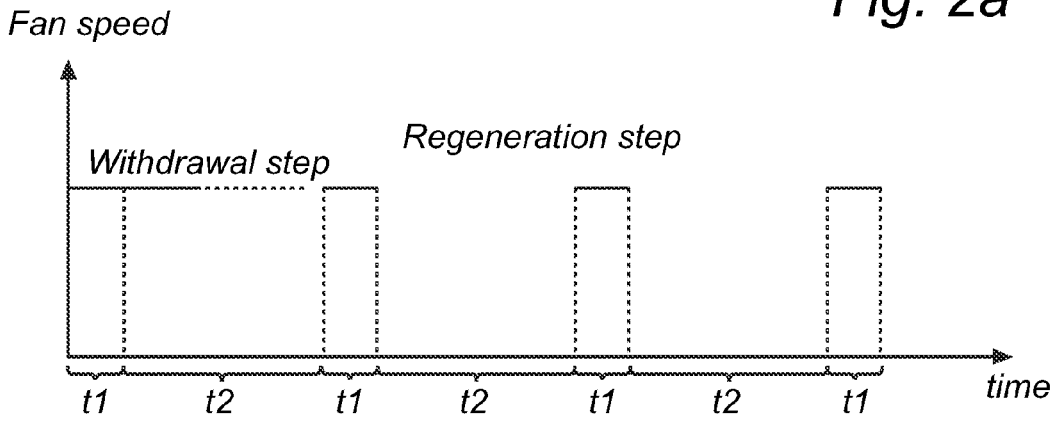

In FIG. 2*b*, the fan speed during the regeneration step of an embodiment of the present invention is shown. Here, the fan 14 is only operated periodically, i.e. it is switched on for a certain time period t1, then switched off for a certain time period t2, wherein t2 may be much longer than t1. Thus, in this embodiment of the present invention, the fan 14 operates discontinuously during the regeneration step.

Hence, in this embodiment as shown in FIG. 2*b*, the time of the operation of the fan 14 is much shorter than the time that the fan 14 is turned off. The operations of the fan 14 during the time periods t1 may be interpreted as "puffs" from the fan 14 such that the air flow during the regeneration step is driven by a cyclic operation of the fan 14 with short times when the fan 14 is on and long times when the fan 14 is off.

Figure 2C:
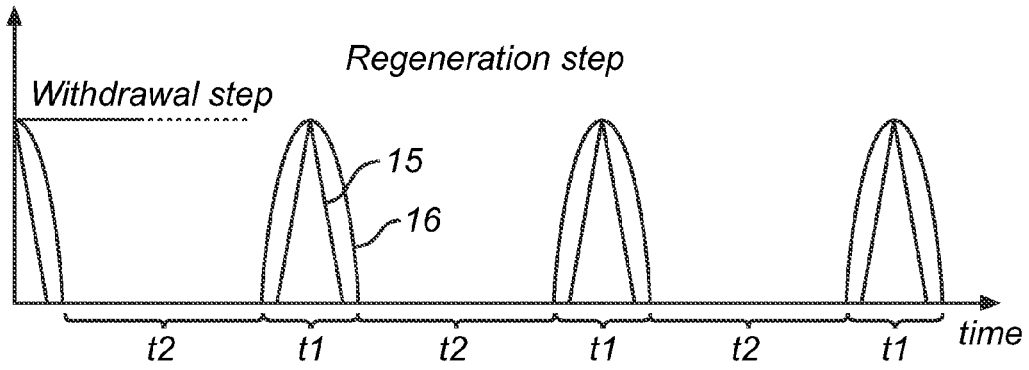

FIG. 2*c* shows an embodiment of the present invention wherein the fan 14 is operated periodically but wherein the fan speed is increased and decreased gradually. As an example, the fan speed may be realized as a saw-tooth function 15, wherein the fan speed is constantly increased to a maximum fan speed and then constantly decreased to a zero fan speed, during the time period t1, and that the fan speed is zero during the time period t2. This operation of the fan speed may be performed again in a cyclic way.

Alternatively, the function may be a sinusoidal function 16, for the increase and decrease of the fan speed of the fan 14 during the time period t1, whereas the fan speed is zero during the time period t2. This operation of the fan may be performed again in a cyclic way.

Figure 3:
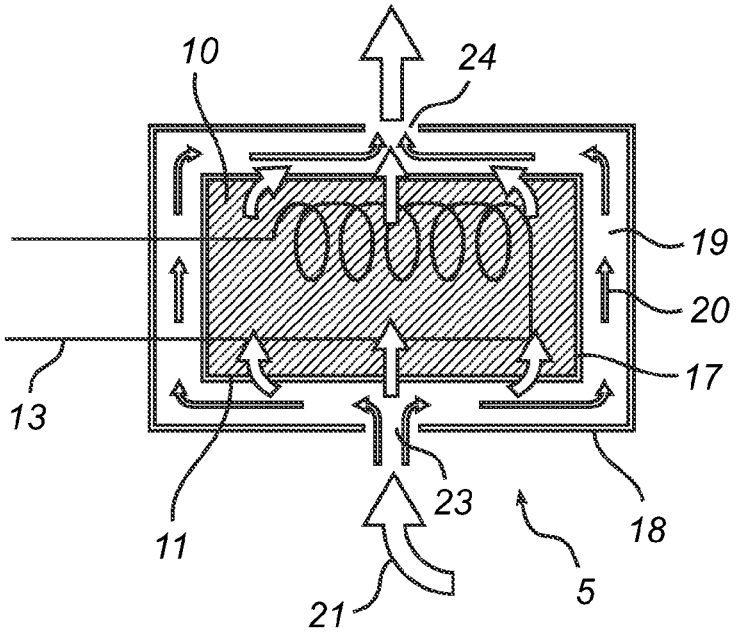
FIG. 3 is a schematic cross-sectional view of a device according to an embodiment of the present invention.

FIG. 3 is a schematic cross-sectional view of the device 5 according to an embodiment of the present invention. The device 5 comprises a container 17 which encloses the bed 11, wherein the container 17 is arranged for a passage of air through the container 17 (also shown in FIG. 4). The container 17, shaped as a parallelepiped, protects the bed 11 from damage and shields the bed 11 from e.g. the fan 14 such that pieces, dust or debris from the drying material 10 do not enter into the fan 14.

The container 17 comprises a heat insulating material such as a mineral material, thereby isolating the heat generated by the heating element 13 when the device 5 is in use. The insulating material may be a Mica mineral, which may be made thin and which has excellent properties regarding heat insulation, low thermal expansion and high mechanical strength.

A housing 18 at least partly encloses the container 17. The housing 18 comprises an inlet 23 and an outlet 24 arranged for passage of air through the housing 18. The housing 18 may comprise a heat insulating material such as a plastic, thereby further improving the insulation of the device 5 and providing a heat insulation towards the exterior.

A space 19 is defined between the container 17 and the housing 18. By this, a small portion of the air 20, which air is circulated by means of the fan 14, may pass in the space 19 around the container 17, whereas a major portion of the air 21 may pass through the container 17 and the drying material 10 in the withdrawal step or regeneration step, when the device 5 is in use.

The air passage in this embodiment may be seen as a small "leakage" of air 20 around the container 17, instead of all air passing through the container 17. This portion of air 20 may cool the housing 18 and furthermore, act as an insulator.

At the outlet 24 of the housing 18, the small portion of the air 20 and the major portion of the air 21 may merge to exit the housing 18.

In FIG. 3, the container 17 is shaped as a parallelepiped and the housing 18 as a somewhat bigger parallelepiped, the container 17 thereby enclosing the housing 18. The space 19 between the container 17 and the housing 18 may be 1-2 mm.

Figure 4:
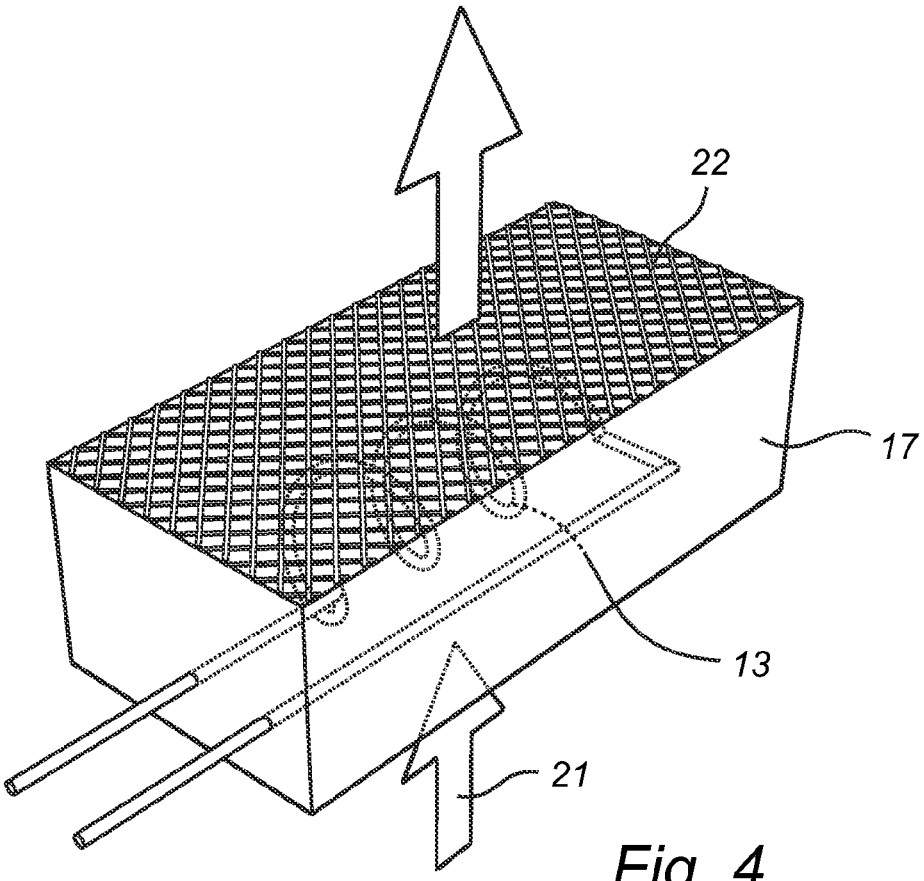
FIG. 4 is a schematic perspective view of a container according to an embodiment of the present invention.

In FIG. 4, the container 17 is shown in a schematic perspective view. The container 17 is shaped as a flat, elongated parallelepiped, wherein the air 21 which is to pass through the container 17 is directed substantially perpendicular to one of the flat surfaces of the container 17. The two sides of the container being perpendicular to the air flow 21, when the device is in use, may comprise e.g. a net 22 of metal wire, whereas the four sides of the container 17 being parallel to the air flow may comprise a Mica mineral.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

For example, the relative sizes and the positions of the components of the dishwasher 1 and the device 5 could vary, as the figures are meant for a schematic illustration only. As an example, any size of the fan 14, the bed 11, the duct 6, or any other component may vary, as the purpose of the figures, to a higher extent than that of depicting relative sizes, is to describe the function of the dishwasher 1. More specifically, the duct 6 may be much thinner, the width of the bed 11 may be smaller, the fan 14 may be bigger, etc.

Furthermore, the positioning of the device 5 may be provided under or over the washing chamber 2, or in any other position such that the device 5 is in fluid communication with the washing chamber 5. As another example, the fan 14 may be provided anywhere in the device 5, still yielding an air flow 9 within the device 5.

Furthermore, the inlet 7 and the outlet 8 of the duct 6 may be provided at positions other than at the top and at the bottom, respectively, of the washing chamber 2. As an example, the inlet 7 may be provided at a lower position than that depicted in FIG. 1.

The invention claimed is:

1. A method of processing air in a dishwasher, the dishwasher comprising a washing chamber and a device, the device comprising a drying material comprising activated alumina and arranged in a bed, a heating element arranged in the bed, and a fan, the method comprising:

circulating the air between the washing chamber and the device such that at least part of the air passes through the bed allowing the air to contact the drying material of said bed;

withdrawing moisture from the air passing through the bed by means of the drying material, the air passing through the bed at a first mean flow rate;

regenerating the drying material by heating the bed by means of the heating element and releasing at least part of the moisture to the air at a second mean flow rate; and altering, during the regeneration step, the fan speed such that the first mean flow rate is higher than the second mean flow rate, wherein the fan speed is substantially periodical such that the fan speed is altered between a first fan speed, being substantially the same as the fan speed during the withdrawal step, and a second fan speed, being zero.

2. The method of claim 1, wherein withdrawing moisture from the air passing further comprises operating the fan with a substantially constant speed.

3. The method of claim 1, wherein regenerating the drying material further comprises operating the fan with substantially constant speed.

4. The method of claim 1, wherein the heating element is an electrical heating resistor in the form of a wire, a coil, a loop, or a sheet.

5. The method of claim 1, wherein regenerating the drying material further comprises heating the drying material with the heating element to a temperature of 100-250° C.

6. The method of claim 1, wherein the device further comprises a container at least partly enclosing the bed, the container being arranged for a passage of air through the container.

7. The method of claim 6, wherein the container comprises a heat resistant insulating material.

8. The method of claim 7, wherein the heat resistant insulating material comprises a mineral material.

9. The method of claim 8, wherein the mineral material is Mica or alumina.

10. The method of claim 6, wherein the device further comprises a housing at least partly enclosing the container wherein the housing comprises an inlet and an outlet arranged for passage of air through the housing.

11. The method of claim 10, wherein the housing comprises an insulating material.

12. The method of claim 11, wherein the insulating material comprises a plastic.

13. The method of claim 10, wherein the container and the housing define a space therebetween, such that a portion of the air passing through the housing passes between the container and the housing, without passing through the bed, when the device is in use.

14. The method of claim 1, wherein regenerating the drying material further comprises heating the drying material with the heating element to a temperature of 130-200° C.

15. The method of claim 1, wherein regenerating the drying material further comprises heating the drying material with the heating element to a temperature of 150-180° C.

* * * * *